US007077708B1

(12) United States Patent
Johnson et al.

(10) Patent No.: US 7,077,708 B1
(45) Date of Patent: Jul. 18, 2006

(54) CONNECTOR ASSEMBLY

(75) Inventors: Philip Wayne Johnson, Bluffton, IN (US); Kamron Mark Wright, Fort Wayne, IN (US)

(73) Assignee: Regal-Beloit Corporation, Beloit, WI (US)

( * ) Notice: Subject to any disclaimer, the term of this patent is extended or adjusted under 35 U.S.C. 154(b) by 0 days.

(21) Appl. No.: 11/357,387

(22) Filed: Feb. 17, 2006

(51) Int. Cl.
*H01R 13/502* (2006.01)

(52) U.S. Cl. ..... 439/687; 439/731; 439/906; 439/696

(58) Field of Classification Search ..... 439/687, 439/696, 701, 731, 660, 906, 942
See application file for complete search history.

(56) References Cited

U.S. PATENT DOCUMENTS 5,447,452 A * 9/1995 Takano ..... 439/696
6,508,679 B1 * 1/2003 Han et al. ..... 439/696

* cited by examiner

*Primary Examiner*—Tho D. Ta
(74) *Attorney, Agent, or Firm*—Armstrong Teasdale LLP

(57) ABSTRACT

A connector assembly configured to engage a motor connector having a plurality of contacts is described. The connector assembly includes a plurality of receptacle terminals and first and second housing portions each having channels formed therein for insertion of the receptacle. The channels include an end further including a slot formed therein where the channels are configured to engage respective sides of the receptacle terminals along their longitudinal axis. The slots define a rectangular opening for insertion of a respective tab terminal into each respective receptacle terminal. Each receptacle terminal includes a wire insulation engaging segment, a wire engaging segment, and a receptacle portion.

20 Claims, 5 Drawing Sheets

CONNECTOR ASSEMBLY

BACKGROUND OF THE INVENTION

This invention relates generally to the connection of power and operational control signals to a motor, and more specifically to an assembly, configured to hold and retain a plurality of terminals for quick and easy connection to the motor.

It is known to construct electronically commutated motors (ECMs) with a housing configured with a molded connector assembly therein. The molded connector typically includes a plurality of terminals therein, several of which are designated for a particular function. Examples of such designations include the above mentioned power and operational control signals which typically originate from an external source. In these known motors, the various signals from the external source are wired to the terminals using a discrete mating terminal attached to a single wire extending from the external source. An exemplary embodiment of such terminals are typically referred to as quick connect terminals or spade terminals. As can be appreciated, multiple single wire terminals increase a possibility that the wiring between the external signal source and the connector of the motor housing will be installed incorrectly. As is also known, an incorrect installation of wiring can cause damage to one or both of the motor and the external signal source.

BRIEF DESCRIPTION OF THE INVENTION

In one aspect, a connector assembly configured to engage a motor connector having a plurality of contacts is provided that includes a plurality of receptacle terminals, a first housing portion, and a second housing portion. The plurality of receptacle terminals each comprise a wire insulation engaging segment, a wire engaging segment extending from the wire insulation engaging segment, and a receptacle portion extending from the wire engaging segment and opposite the wire insulation engaging segment. Each receptacle terminal has a longitudinal axis defining a first side and a second side for the receptacle terminal. The first housing portion comprising a channel formed therein for each of the receptacle terminals. The channels each comprise an end comprising a slot formed therein. The channels are configured to engage the first side of the receptacle terminals along their longitudinal axis, and the end of the channels are configured to engage an end of the receptacle terminal end. The second housing portion comprises a channel formed therein for each of the receptacle terminals. The channels comprise an end comprising a slot formed therein, and the channels are configured to engage the second side of the receptacle terminals along their longitudinal axis. The end of the channels are configured to engage receptacle terminal ends. The first and second housing portions are configured for attachment to one another, and the slots define a rectangular opening for insertion of a respective tab terminal into each respective receptacle terminal.

In another aspect, a housing for a plurality of receptacle terminals is provided that comprises a first housing component and a second housing component. The first housing component comprises a channel formed therein that is configured for insertion of a first side of each of the plurality of receptacle terminals. Each channel comprises a first end having a slot formed therein and a second end configured as a semi circular channel The second housing component also comprises a channel formed therein configured for insertion of a second side of each of the plurality of receptacle terminals. Each channel comprises a first end having a slot formed therein and a second end configured as a semi circular channel. The first and second housing components are configured for attachment to one another, and each slot defines a rectangular opening for insertion of a respective tab terminal. Respective semi circular channels are configured to engage the insulation of a wire utilized with a respective receptacle terminal.

In still another aspect, an electrical interconnection system for a motor is provided that includes a motor chassis, a first electrical connector mounted onto said chassis, a second electrical connector configured to engage the first electrical connector, where the second electrical connector includes a plurality of receptacle terminals, a first housing portion, and a second housing portion. The first electrical connector includes a plurality of openings therein and a plurality of tab terminals that are mounted in respective openings and configured to provide operational signals and power to and from the motor. The second electrical connector is configured to provide motor operational signals and power to and from the motor. The plurality of receptacle terminals each include a receptacle portion having an end, and a longitudinal axis defines a first side and a second side for the receptacle terminals. The first housing portion includes a channel formed therein for each of the receptacle terminals, and the channels have an end comprising a slot formed therein. The channels are configured to engage the first side of the receptacle terminals along their longitudinal axis, and the end of the channels are configured to engage the receptacle portion end. The second housing portion includes a channel formed therein for each of the receptacle terminals, and the channels have an end comprising a slot formed therein. The channels are configured to engage the second side of the receptacle terminals along their longitudinal axis, and the end of the channels is configured to engage the receptacle portion end. The first and second housing portions are configured for attachment to one another, and the slots define a rectangular opening for insertion of a respective tab terminal into each respective receptacle terminal.

DETAILED DESCRIPTION OF THE INVENTION

Figure 1:
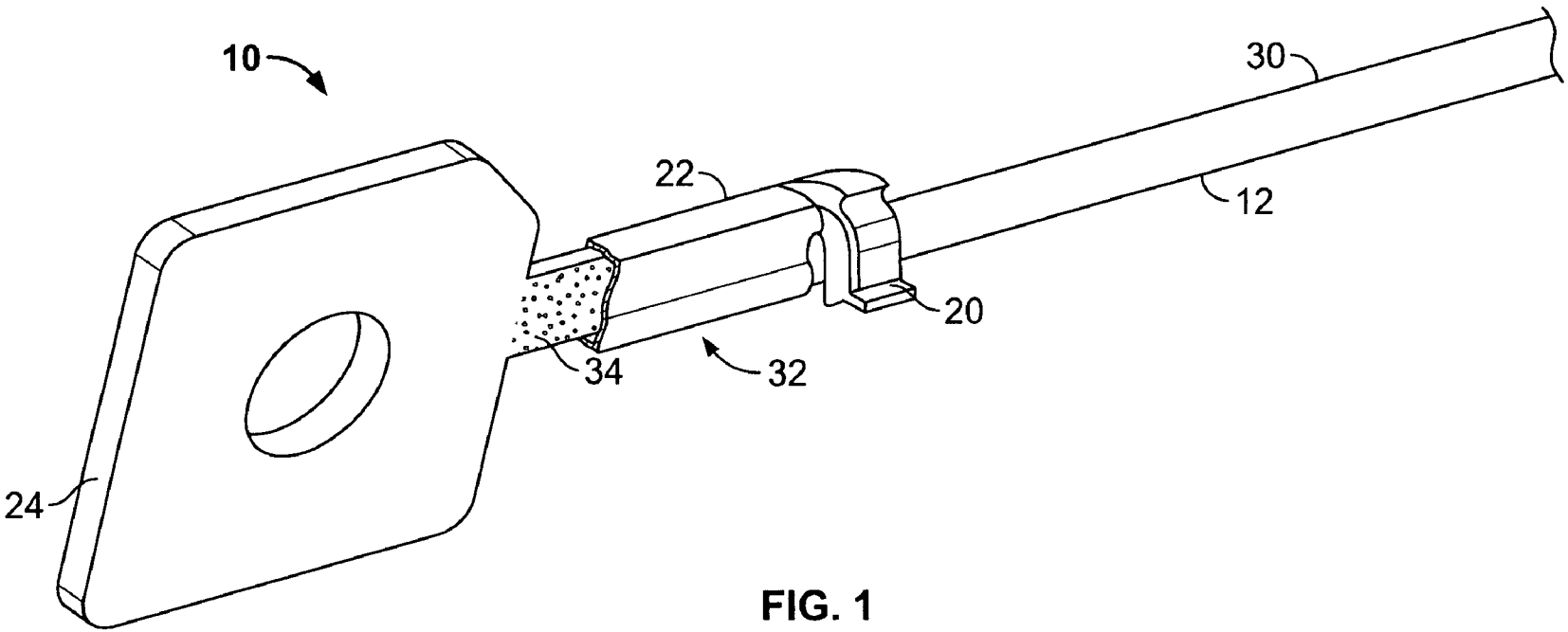
FIG. 1 is a schematic view of a tab terminal and a wire extending therefrom.

FIG. 1 is a schematic view of a tab terminal 10 illustrating a wire 12 extending therefrom. Tab terminal 10 includes a wire insulation engaging segment 20, a wire engaging segment 22 extending from wire insulation engaging segment 20, and a tab portion 24 extending from wire engaging segment 22. So that wire 12 can be used with tab terminal 10, a length of insulation 30 is removed from an end portion 32 of wire 12, exposing conductor 34. Conductor 34 is crimped within wire engaging segment 22 and insulation 30 is crimped within wire insulation engaging segment 20. Crimping conductor 34 within wire engaging segment 22 provides a good electrical connection between wire 12 and tab terminal 10, and crimping insulation 30 within wire insulation engaging segment 20 provides some strain relief against breakage for conductor 34 which is located within insulation 30.

Figure 2:
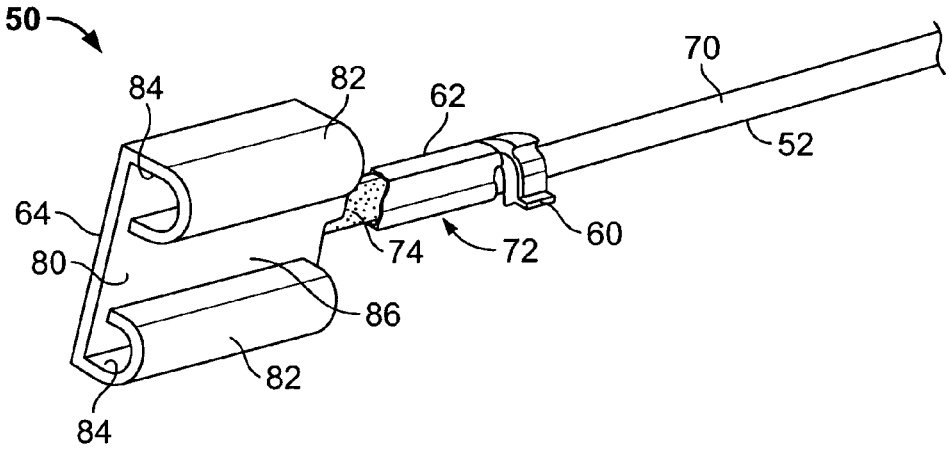
FIG. 2 is a schematic view of a receptacle configured to mate with the tab terminal shown in FIG. 1, and a wire extending from the receptacle.

FIG. 2 is a schematic view of a receptacle 50 configured to mate with tab terminal 10 (shown in FIG. 1). A wire 52 is illustrated extending from the receptacle 50. Receptacle 50 includes a wire insulation engaging segment 60, a wire engaging segment 62 extending from wire insulation engaging segment 60, and a receptacle portion 64 that extends from wire engaging segment 62. For utilization with receptacle 50, a length of insulation 70 is removed from an end portion 72 of wire 52, exposing conductor 74. Conductor 74 is crimped within wire engaging segment 62 to provide both a good electrical connection between wire 52 and receptacle 50. Crimping insulation 70 within wire insulation engaging segment 60 provides some strain relief for conductor 74 which is located within insulation 70.

As can be appreciated by those skilled in the art, tab terminal 10 and receptacle 50 are configured to mate with, or engage, one another to provide an electrical connection between the two conductors crimped respectively thereto. More specifically, tab portion 24 of tab terminal 10 is configured to slidingly engage receptacle 50 between a planar member 80 and two U-shaped members 82 that extend from sides 84 of planar member 80 and back towards a center portion 86 of planar member 80. U-shaped members 82 are configured to apply a pressure to an inserted tab terminal 10 so that in addition to the electrical contact at U-shaped members 82, tab portion 24 and planar member 80 are substantially adjacent to one another. This substantially adjacent interconnection provides a bulk of the electrical and physical connection between tab terminal 10 and receptacle 50. The electrical connection between a single tab terminal 10 and a single receptacle 50 is an interconnection for a single electrical signal. However, in most applications, more than a single electrical connection is needed.

Figure 3:
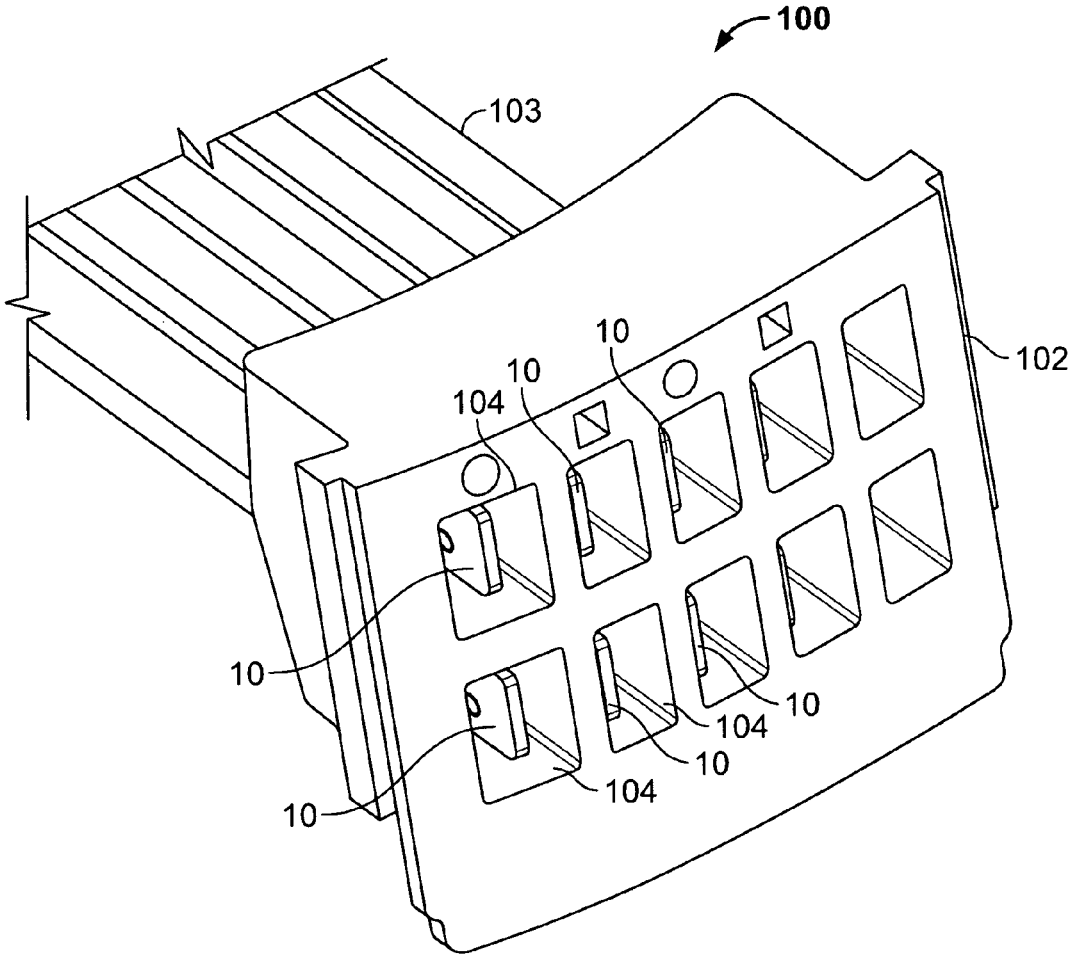
FIG. 3 is an illustration of a connector capable of being mounted in a motor chassis, and having a plurality of the tab terminals shown in FIG. 1 mounted therein.

FIG. 3 is an illustration of a wiring harness 100 that includes a connector 102. In one known application and as further illustrated below, connector 102 is mounted to a motor chassis with wires 103 of wiring harness utilized to provide the various electrical signals throughout the motor. In the embodiment illustrated, connector 102 is configured with a plurality of conductors mounted therein. In the embodiment illustrated, each conductor (e.g. tab terminal 10) is substantially centered within an opening 104 of connector 102. As is described below, each of openings 104 is sized for insertion of a portion of a connector assembly that includes one of receptacles 50 configured to engage a respective tab terminal 10 as further described below. Specifically, connector 102 includes a plurality of tab terminals 10 (shown in FIG. 1) mounted therein, to provide an electrical access for receiving and outputting the electrical signals utilized for proper motor operation. In one embodiment, the motor is an electronically commutated motor. In known applications, individual wires from, for example, a motor controller or power supply, having receptacles 50 crimped thereon are utilized to provide the interface signals and electrical power utilized to operate such motors and are individually inserted into connector 102 to engage tab terminals 10.

However, the wiring of individual wires to provide power and control signals to and from such motors is tedious and prone to errors as it is relatively easy to mix up which wire have a receptacle 50 thereon is to be attached to which tab terminal 10 within connector 102. These described problems associated with individually wiring conductors with receptacles 50 thereon to connector 102 is at least partially alleviated through utilization of connector 150, shown in a frontal view in FIG. 4. Connector 150 is configured to hold a plurality of receptacles 50 (also shown in FIG. 2). Once individual wires and receptacles 50 are properly placed within connector 150, providing the proper operational signals to a motor is accomplished with relative ease. Replacement of a failed motor is eased as a technician does not have to attach individual wires and receptacles to the replacement motor. In addition, utilization of connector 102 helps to avoid wiring errors that may arise when individual wires and receptacles 50 are attached to a motor, especially during motor replacement.

Figure 4:
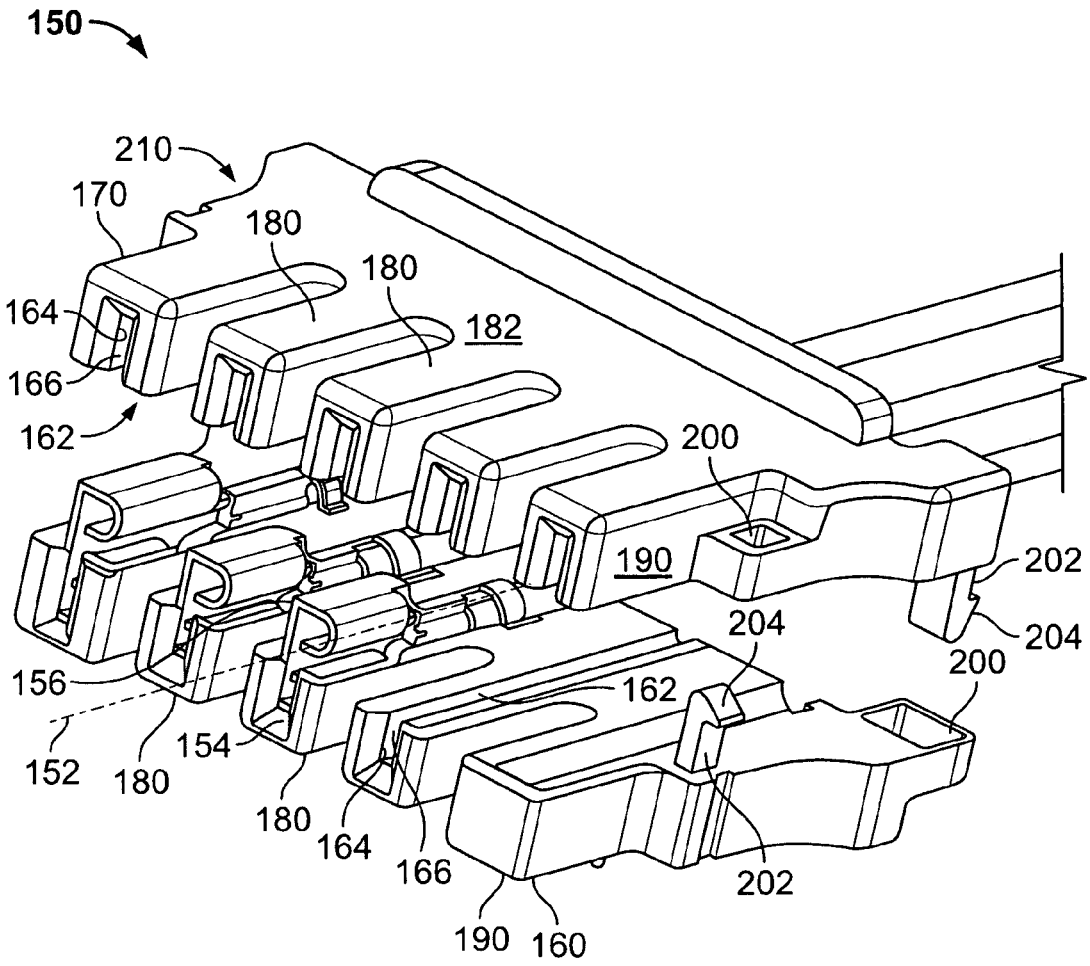
FIG. 4 is an exploded view of a connector assembly configured to retain a plurality of the receptacles shown in FIG. 2.

Now specifically referring to FIG. 4, connector 150 includes a plurality of receptacle terminals 50 mounted therein, each having a longitudinal axis 152 defining a first side 154 and a second side 156 for each receptacle terminal 50. A first housing portion 160 of connector 150 has a plurality of channels 162 formed therein for placement of each respective receptacle terminal 50. For clarity, one of channels 162 is illustrated without a receptacle terminal 50 therein. Each channel 162 includes an end 164 which is adjacent a slot 166 formed in housing portion 160. Each channel 162 is shaped and configured to engage substantially one half, as defined by longitudinal axis 152, of a receptacle terminal 50 with the end of each terminal 50 abutting end 164 of channel 162.

A second housing portion 170 is similar to first housing portion 160 with respect to an engagement of receptacle terminals 50 and certain components of second housing portion 170 are illustrated using the same reference numerals as first housing portion 160. As housing portions 160 and 170 are joined together, slots 166 from each converge to provide a rectangular opening that allows entry of one or more tab terminals 10 (shown in FIG. 1) into connector 150 for engagement of respective receptacles 50 housed within connector 150. In one embodiment, slots 166 are beveled to provide additional alignment for insertion of respective tab terminals 10 into the slots 166.

As shown in FIG. 4, to provide channels 162 and slots 166, housing portions 160 and 170 are configured with a plurality of rectangular protrusions 180 which extend from a main body 182. These protrusions 180 are shaped for insertion into openings 104 of connector 102. In the embodiment illustrated, channels 162 and slots 166 are formed within these protrusions 180. One protrusion 190, is formed without channels 162 and slots 166 and therefore provides a keying function such that connector 150 cannot be improperly inserted into connector 102 (shown in FIG. 3). In this embodiment, one of the openings 104 of connector 102 would be configured without a tab terminal 10 to allow insertion of protrusion 190. More specifically, connector 150 cannot be inserted into connector 102 if connector 150 is upside down with respect to connector 102 when insertion is attempted.

Housing portions 160 and 170 are configured with mechanical attachment devices that provide for a mechanical engagement between the two. More specifically, as illustrated in FIG. 4, housing portions 160 and 170 are configured with a plurality of rectangular openings 200 through which are inserted rectangular protrusions 202 that include a tang 204 on their ends to provide a removable locking engagement with the respective rectangular opening 200. In a specific embodiment, an end 210 of housing portions 160 and 170 are also configured with the components of the mechanical attachment devices in order to maintain an engagement between the housing portions 160 and 170. In one embodiment, housing portions 160 and 170 are molded as identical pieces.

Figure 5:
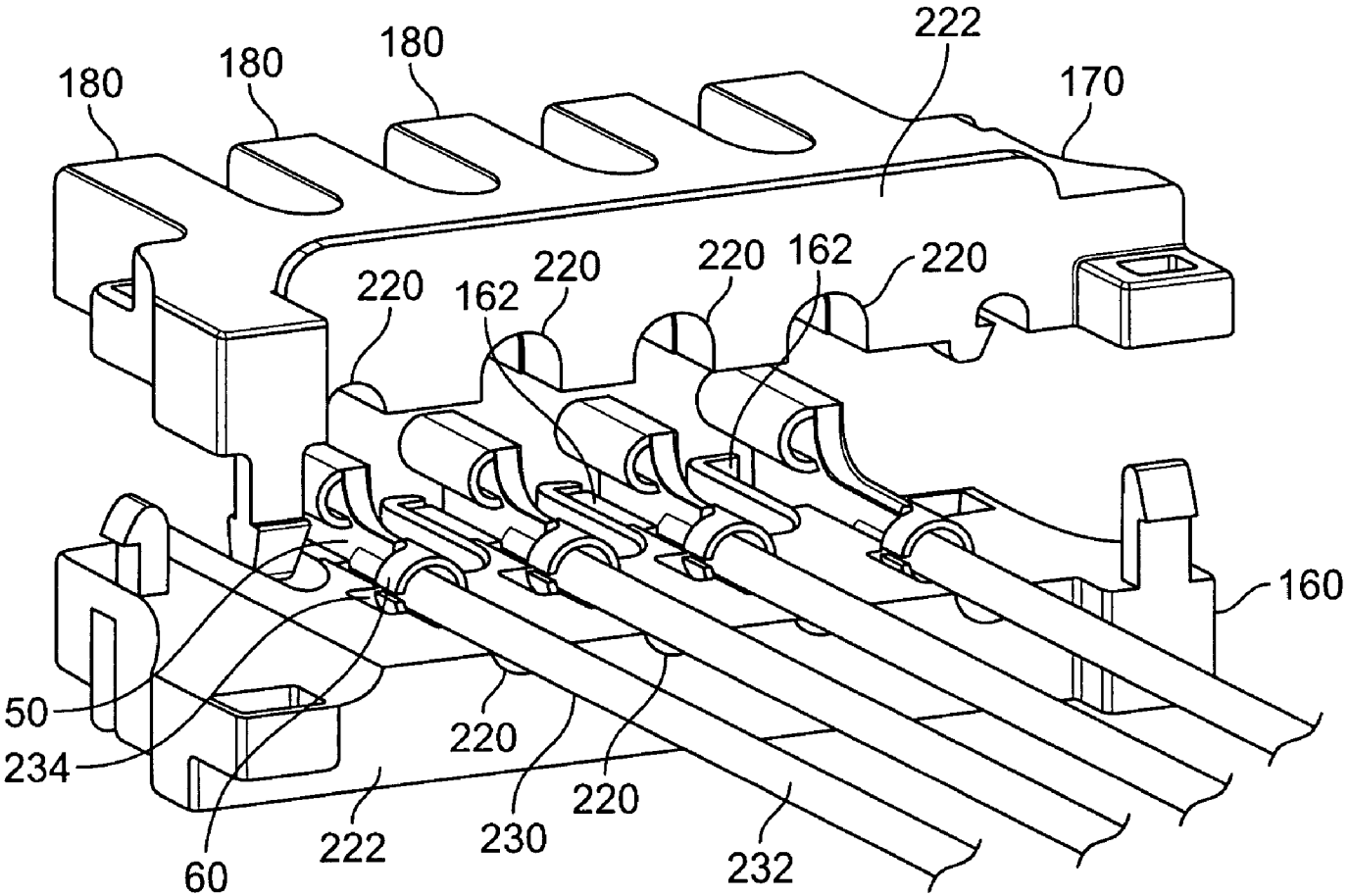
FIG. 5 is a rear view of the connector assembly shown in FIG. 4.

FIG. 5 is a rear view of connector 150 further illustrating housing portions 160 and 170. As illustrated, housing portions 160 and 170 include a plurality of semi-circular bores 220 that extend from channels 162 through to a rear 222 of housing portions 160 and 170. Rather than being substantially rectangular, as are the channels 162 that engage the planar members 80 and U-shaped members 82 (shown in FIG. 2) of receptacles 50 as described above, the semi-circular bores 220 are sized to engage insulation 230 of wire 232 such that housing portions 160 and 170 also provide a measure of strain relief for wire 232. Between channels 162 and bores 220 is an enlarged semicircular area 234 that is sized to fit a portion of wire insulation engaging segment 60 for each receptacle 50. This arrangement (i.e., bores 220 and enlarged semicircular area 234) also prevents a user from being able to pull the receptacles out from the back of connector 150, when properly assembled, providing improved safety. The spacing between receptacles 50 further meets standards for voltage spacing and flammability.

Figure 6:
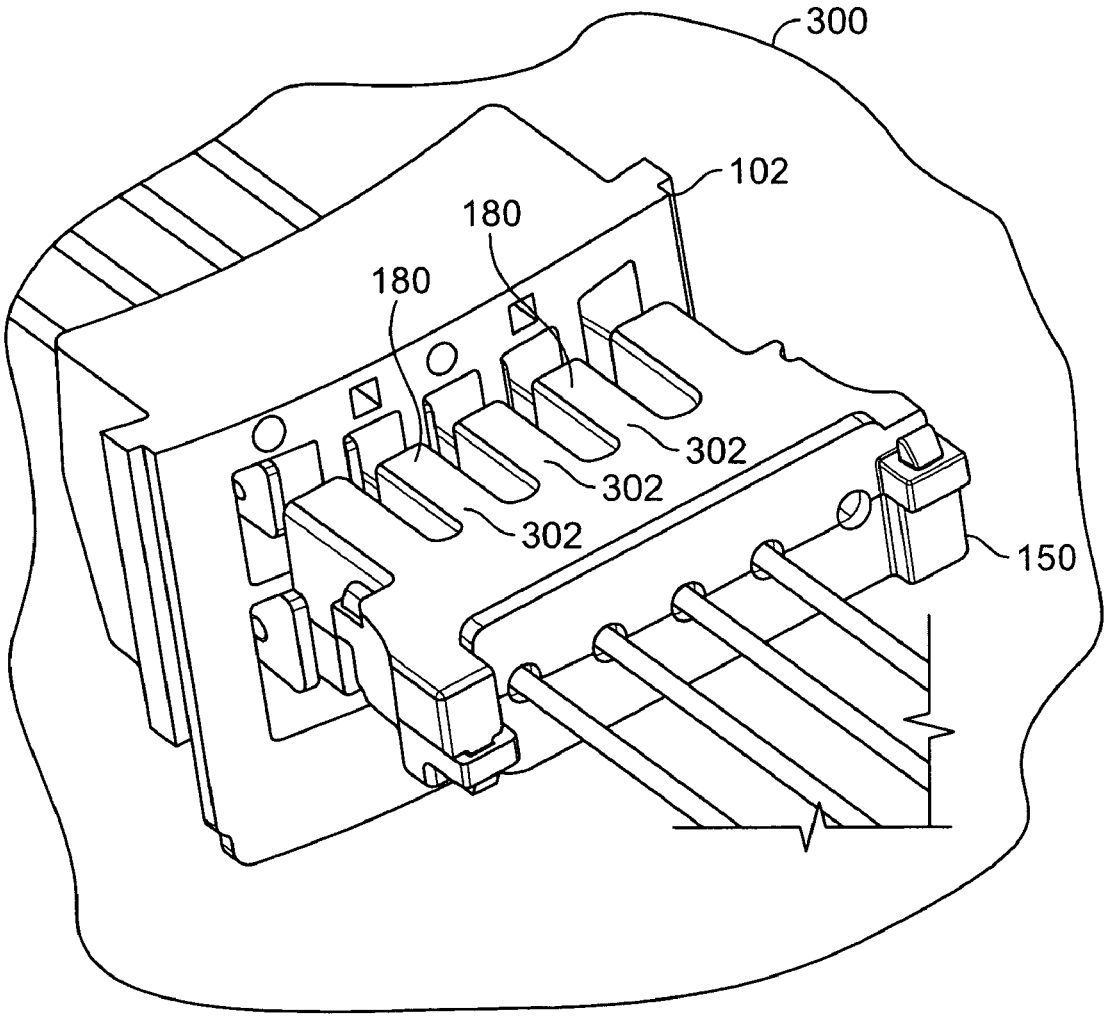
FIG. 6 is an illustration of the connector assembly shown in FIG. 4 preparing to engage the connector shown in FIG. 3 which is mounted in a motor chassis.

FIG. 6 is an illustration of connector 150 preparing to engage a portion connector 102 which is mounted in a motor chassis 300. As is best shown in FIG. 6, the protrusions 180 of each housing portion 160 and 170, upon attachment of the housing portions 160 and 170 form members 302 that are sized for insertion into openings 104 of connector 102. Insertion of members 302 into openings 104 also causes engagement of receptacles 50 (not shown in FIG. 6) with respective tab terminals 10.

Utilization of connector 150, which in one embodiment is molded from a plastic, results in a motor power connection system that allows a user to provide an interface between a motor assembly and a control assembly or between other electrical devices through the application of at least power and ground connections. Connector 150 further allows for the use of multiple common quick connect terminals (receptacles 50) within a single assembly. For example, in one specific application, connector 150 is configured with one 0.250 inch by 0.032 inch receptacle and three 0.187 inch by 0.020 inch receptacles. As will be appreciated, various sizes for receptacles also may result in wires having various wire insulation diameters. Varying wire insulation diameters are accommodated by connector 150 as the semi circular portion of channels 162 are not restricted to use with any specific diameter of wire insulation.

Connector 150 is capable of interfacing with connector 102 and is configured to not come loose due to vibration. As connector 150 is embodied as a clamshell configuration (e.g., two mating halves, housing portions 160 and 170), connector 150 is configured to allow insertion of common quick connecting terminals (e.g., receptacles 50 (shown in FIGS. 2, 4, and 5)) before the two halves of connector 150 are joined together. Connector 150 holds receptacles 50 in place and in correct alignment so that the wires entering connector 150 may be electrically connected to the correct tab terminals within connector 102.

While the invention has been described in terms of various specific embodiments, those skilled in the art will recognize that the invention can be practiced with modification within the spirit and scope of the claims.

What is claimed is:

1. A connector assembly configured to engage a motor connector having a plurality of contacts mounted therein, said connector assembly comprising:

a plurality of receptacle terminals each comprising a wire insulation engaging segment, a wire engaging segment extending from said wire insulation engaging segment, and a receptacle portion extending from said wire engaging segment opposite said wire insulation engaging segment and comprising an end, each said receptacle terminal having a longitudinal axis defining a first side and a second side for said receptacle terminals;

a first housing portion comprising a channel formed therein for each of said receptacle terminals, said channels comprising an end comprising a slot formed therein, said channels configured to engage the first side of said receptacle terminals along their longitudinal axis, said end of said channels configured to engage said receptacle portion end; and a second housing portion comprising a channel formed therein for each of said receptacle terminals, said channels comprising an end comprising a slot formed therein, said channels configured to engage the second side of said receptacle terminals along their longitudinal axis, said end of said channels configured to engage said receptacle portion end, said first and said second housing portions configured for attachment to one another, said slots defining a rectangular opening for insertion of a respective tab terminal into each respective said receptacle terminal.

2. A connector assembly according to claim 1 wherein said housing portions comprise a keying arrangement.

3. A connector assembly according to claim 1 wherein said slots defining a rectangular opening for insertion of a respective tab terminal comprise a beveled surface.

4. A connector assembly according to claim 1 wherein said housing portions comprise a molded plastic.

5. A connector assembly according to claim 1 wherein said receptacle portion comprises:

a planar member further comprising two sides and a center portion therebetween; and two U-shaped members that extend from said sides of said planar member back towards said center portion of said planar member.

6. A connector assembly according to claim 1 wherein said housing portions are configured with one or more sets of mechanical attachment devices, said mechanical attachment devices configured to maintain an engagement between said first and said second housing portions.

7. A connector assembly according to claim 6 wherein said mechanical attachment devices each comprise:

a rectangular protrusion extending from one of said housing portions, said rectangular protrusion comprising a tang on an end thereof; and a rectangular opening formed in the other of said housing portions, said rectangular protrusion and tang configured to engage said opening when inserted into said opening.

8. A connector assembly according to claim 1 wherein said first and said housing portions each comprise an insulation engaging area comprising a plurality of semi-circular bores extending from a rear of said housing portions, said semi circular bores configured to engage insulation of a wire attached to one of said receptacles when said first and second housing portions are attached to one another.

9. A connector assembly according to claim 8 wherein said semi circular bores extend between the rear of said housing portions to said channels for respective said receptacle terminals.

10. A housing for a plurality of receptacle terminals comprising:

a first housing component comprising a channel formed therein configured for insertion of a first side of each of the plurality of receptacle terminals, each said channel comprising a first end having a slot formed therein and a second end configured as a semi circular bore; and a second housing component comprising a channel formed therein configured for insertion of a second side of each of the plurality of receptacle terminals, each said channel comprising a first end having a slot formed therein and a second end comprising a semi circular bore, said first and said second housing components configured for attachment to one another, each said slot defining a rectangular opening for insertion of a respective tab terminal, respective said semi circular bores configured to engage insulation of a wire utilized with a respective receptacle terminal.

11. A housing according to claim 10 wherein said housing components comprise a keying arrangement.

12. A housing according to claim 10 wherein the rectangular opening comprises a beveled surface.

13. A housing according to claim 10 wherein said housing components comprise a molded plastic.

14. A housing according to claim 10 wherein said housing components are configured with one or more sets of mechanical attachment devices, said mechanical attachment devices configured to maintain an engagement between said first and said second housing components.

15. A housing according to claim 14 wherein said mechanical attachment devices each comprise:

a rectangular protrusion extending from one of said housing components, said rectangular protrusion comprising a tang on an end thereof; and a rectangular opening formed in the other of said housing components, said rectangular protrusion and tang configured to engage the other of said housing components when inserted into said opening.

16. An electrical interconnection system for a motor comprising:

a motor chassis;

a first electrical connector mounted onto said chassis, said first electrical connector comprising a plurality of openings therein and a plurality of tab terminals, said tab terminals mounted in respective said openings and configured to provide operational signals and power to and from the motor; and a second electrical connector configured to engage said first electrical connector, said second electrical connector configured to provide motor operational signals and power to and from the motor, said second electrical connector comprising:

a plurality of receptacle terminals each comprising a receptacle portion comprising an end, each said receptacle terminal having a longitudinal axis defining a first side and a second side for said receptacle terminals;

a first housing portion comprising a channel formed therein for each of said receptacle terminals, said channels comprising an end comprising a slot formed therein, said channels configured to engage the first side of said receptacle terminals along their longitudinal axis, said end of said channels configured to engage said receptacle portion end; and a second housing portion comprising a channel formed therein for each of said receptacle terminals, said channels comprising an end comprising a slot formed therein, said channels configured to engage the second side of said receptacle terminals along their longitudinal axis, said end of said channels configured to engage said receptacle portion end, said first and said second housing portions configured for attachment to one another, said slots defining a rectangular opening for insertion of a respective said tab terminal into each respective said receptacle terminal.

17. An electrical interconnection system for a motor according to claim 16 wherein said receptacle portion comprises:

a planar member further comprising two sides and a center portion therebetween; and two U-shaped members that extend from said sides of said planar member back towards said center portion of said planar member.

18. An electrical interconnection system for a motor according to claim 16 wherein attachment of said first and said second housing portions forms members sized for insertion into said openings of said first electrical connector, said receptacles within a respective member.

19. An electrical interconnection system for a motor according to claim 16 wherein said first and said second housing portions each comprise an insulation engaging area comprising a plurality of semi-circular bores extending from a rear of said housing portions, said semi circular bores configured to engage insulation of a wire attached to one of said receptacles when said first and second housing portions are attached to one another.

20. An electrical interconnection system for a motor according to claim 19 wherein said semi circular bores extend between the rear of said housing portions to said channels for respective said receptacle terminals.

* * * * *